US005379606A

United States Patent [19]

Katsuki et al.

[11] Patent Number: 5,379,606

[45] Date of Patent: Jan. 10, 1995

[54] CONTROL DEVICE FOR AN AIR CONDITIONER

[75] Inventors: Hikaru Katsuki, Kiryu; Masayuki Shimizu, Ohizumi; Minoru Kato, Sumiyoshi; Tetsuo Inoue, Ohta; Masakazu Hosoya, Shironouchi, all of Japan

[73] Assignee: Sanyo Electric Co., Ltd., Moriguchi, Japan

[21] Appl. No.: 51,470

[22] Filed: Apr. 22, 1993

[30] Foreign Application Priority Data

May 11, 1992 [JP] Japan ..... 4-117435

[51] Int. Cl.[6] ..... F25B 49/02

[52] U.S. Cl. ..... 62/126; 62/199

[58] Field of Search ..... 62/126, 129, 130, 175, 62/199, 200, 208, 209, 203, 226, 228.1, 228.3, 229, DIG. 17; 236/1 B; 165/12, 22, 29

[56] References Cited

U.S. PATENT DOCUMENTS 4,211,089 7/1980 Mueller et al. ..... 62/126 X
4,246,763 1/1981 Mueller et al. ..... 62/126 X
4,298,056 11/1981 Nelson ..... 165/12
4,480,442 11/1984 Ide et al. ..... 62/175
4,503,686 3/1985 Moizumi ..... 165/22 X
4,627,483 12/1986 Harshbarger, III et al. .... 165/29 X
5,040,376 8/1991 Ueno ..... 165/22 X

FOREIGN PATENT DOCUMENTS 2249168 4/1992 United Kingdom .

*Primary Examiner*—Harry B. Tanner
*Attorney, Agent, or Firm*—Darby & Darby

[57] ABSTRACT

An object of the present invention is to provide an air conditioner in which the feedback of liquid refrigerant to a compressor is prevented and whose refrigerating cycle is constituted with an indoor side heat exchanger, a compressor, an outdoor side heat exchanger, and a pressure reducer. The controller of the air conditioner comprises a temperature control means which performs the cooling operation for a room in controlling the start or stop of the operation of the compressor based on the change of the room temperature, a protective means which stops the operation of the compressor compulsorily independent of the operation of the temperature control means when the open air temperature becomes lower than a specified temperature, and a display means for displaying the operation of the protective means.

7 Claims, 12 Drawing Sheets

+12[V]
LB1234
TMS73C45A-C78406
(C7)(C6)
(B4)(B3)(D7)
(B7)(B6)
(RESET)(A2)(A1)(A0)
(A3)
(C0)
(C1)
(TEST)
OUT
IN
OSC
(VSS)
DC5V
+5[V]
CT25U-VA
CM

CONTROL DEVICE FOR AN AIR CONDITIONER

BACKGROUND OF THE INVENTION

The present invention relates, in particular, to protective operations when the outdoor air temperature becomes low in cooling operation in the case of an air conditioner of separation type being constituted with indoor units and outdoor units.

There is an example of the prior art about the air conditioner which is described in a Japanese Utility Model laid-open No. Hei3-77177.

In the case of a controller for an air conditioner described in the gazette, when the outdoor air temperature is higher than 20° C., a fan motor of the outdoor unit is operated in H (high speed) quantity and when the outdoor air temperature is lower than 20° C. the fan motor of the outdoor unit is operated in L (low speed) draft quantity to control the lowering of the pressure on the low pressure side in refrigerating circuit, and when the pressure on the low pressure side is lowered below a specified pressure, a compressor and the fan motor of the outdoor unit are stopped. Owing the constitution as described in the above, the lowering of the pressure on the low pressure side in the refrigerating circuit is prevented when the outdoor air temperature is low.

There is another example of the prior art as shown in a Japanese Utility Model laid-open No. Sho62-164531. In the case of an air conditioner described in the gazette, the outdoor air temperature is detected in a heating operation, and when the temperature becomes lower than a specified temperature, the heating operation in heat pump cycle is changed over to a heating operation by an electric heater. As described in the above, when the outdoor air temperature is low, the operation in the heat pump cycle, in other words, the operation of a compressor is stopped, that is, when the operation efficiency in the heat pump cycle is low, the operation of the compressor is stopped to prevent the unnecessary consumption of energy.

When the outdoor air temperature is specially low, there has been a trouble that the evaporation of refrigerant in an outdoor side heat exchanger is not performed sufficiently and liquid compression can be produced to break the compressor; however, as described in the above, such a breakage of the compressor is prevented by the stop of operation of compressor when the outdoor air temperature is low.

A further example of the prior art is described in a Japanese laid-open Patent Application No. Hei2-121598. In an air conditioner shown in the gazette, 3 indoor units are connected to 1 outdoor unit. A remote controller is provided to each of these indoor units, and the operation of each indoor unit is controlled by the remote controller of exclusive use.

In the conventional air conditioner, however, an abnormal stop of a compressor is operated in a lowering period of the pressure on the low pressure side in refrigerating circuit. Therefore, a low pressure switch for detecting the low pressure on the low pressure side in the refrigerating cycle is needed and also when the pressure on the low pressure side is in a normal range and the outdoor air temperature is specially lowered, the operation of the compressor is not stopped; therefore, there has been a problem, such as an occurrence of refrigerant liquid-back to the compressor.

Moreover, when an indoor side heat exchanger is acting as an evaporator, in general, condensed water (drain water) drops from the indoor side heat exchanger. In the case of the air conditioner in which the condensed water is once received with a drain pan and then the water is discharged outside the indoor unit with a pump, the condensed water is produced for a certain period of time (a period of time till the temperature of the indoor side heat exchanger reaches to the room temperature) after the stop of operation of the compressor, so that if the operation of the pump is stopped simultaneously with the stop of operation of the compressor, the condensed water may overflow from the drain pan.

In the case of the above-mentioned prior art example (a Japanese Utility Model laid-open No. Sho62-164531), when the outdoor side air temperature becomes low, the heating operation in the heat pump cycle is switched to the heating operation by the electric heater. Because of this, the capacity in the heating operation is proportional to the heat generation capacity of the electric heater.

Therefore, the electric heater of a large heat generation capacity is needed to obtain a sufficient heating capacity (For a room of about 13 $m^2$, heat generation capacity of about 5 kW will be needed.). For general dwelling houses, however, a capacity (the maximum current capable of flowing safely through a branch circuit) is limited from the point of view of safety. For example, when the capacity is 30 A, the operating current of a circuit breaker is 20 A, so that an allowable electric heater capacity is 2 kW at a maximum; therefore, there has been a problem that the heating capacity is not sufficient when the outdoor air temperature is low.

In order to use the electric heater of the order of 5 kW, the branch circuit to be exclusively used for the electric heater has to be provided and further a large sized casing for protecting the electric heater is needed; thereby, there has been a problem that the air conditioner itself has to be a large sized one.

Further in the case of an air conditioner constituted as mentioned in the above, when a plurality of indoor units are provided, individual setting values have to be set for these indoor units and the operation controls are made to be complicated. There has been a problem that erroneous setting may occur such as the setting of different operation modes (cooling operation, heating operation, defrosting) for indoor units.

There has been a problem that the control device of the outdoor unit has to be a large sized and complicated one since the indoor units are all connected to the outdoor unit through signal lines and the outdoor unit has to communicate with all of these indoor units.

SUMMARY OF THE INVENTION

The present invention is invented considering the problems mentioned in the above, and an object of the present invention is to provide an air conditioner in which refrigerant liquid-back to a compressor is prevented.

Another object of the present invention is to provide an air conditioner in which the leak of condensed water from an indoor side heat exchanger is prevented.

A further object of the present invention is to provide an air conditioner in which a heating operation in heat pump cycle is stopped and a signal is output to start a heating operation using an electric heater, a furnace, a boiler, etc. when the open air temperature becomes low.

Yet another object of the present invention is to make it possible, in an air conditioner having a plurality of indoor units, to perform the setting of respective indoor units simultaneously, and to lighten the load on control devices concerning the transmission and reception of signals with each of these indoor units and the outdoor unit.

An air conditioner according to the present invention is constituted with an indoor unit having an indoor side heat exchanger for performing heat exchange with the air in a room and an outdoor unit having an outdoor side heat exchanger for performing heat exchange with the outdoor side air, and has a refrigerating cycle constituted with the indoor side heat exchanger, a compressor, the outdoor side heat exchanger and an expansion device; the controller of the air conditioner comprises a temperature control means which performs cooling operation in controlling the compressor to be operated at a full capacity or to stop the operation, a protective means to stop the compressor compulsorily independent of the operation of the temperature control means when the outdoor air temperature becomes lower than a specified temperature, and an indicate means which displays the operation of the protective means when the protective means is operated.

The indoor unit has a constitution in which the dropped water from the indoor side heat exchanger is pumped up to a high position and then the water is discharged to outside the indoor unit; the controller comprises a pump control means which operates the pump for a predetermined period of time after the start of operation of the protective means.

Further, the indoor unit comprises a draft means for expediting the heat exchange between the air inside a room and the indoor side heat exchanger, and the pump control means operates the draft means while the pump is operated.

An air conditioner according to the present invention comprises a refrigerating cycle constituted to be able to perform heating operation of a room using a compressor, a condenser, an expansion device and an evaporator, and a controller of the air conditioner comprises a control means which outputs a signal to stop heating operation and starts the other heating device when the outdoor air temperature becomes lower than a specified temperature.

In the case of an air conditioner according to the present invention, it is made possible to combine an outdoor unit having a compressor and an outdoor side heat exchanger, and a plurality of indoor units each having an indoor side heat exchanger respectively, and to perform air conditioning operation using individual indoor units; the controller of the air conditioner is constituted with an outdoor side control means for controlling the operation of the outdoor unit, an indoor side control means A for controlling the operation of a specified indoor unit, and an indoor side controller B for controlling the operation of the other indoor units; the controller comprises a first signal line which transmits a signal for controlling the outdoor unit to the outdoor side control means in connecting the outdoor side control means and the indoor side control means A to each other, a second signal line which transmits a signal which is set for controlling the operation of the specified indoor unit from the specified indoor unit to the other indoor units and a signal expressing the occurrence of a trouble in the other indoor units from the other indoor units to the specified indoor unit in connecting the specified indoor unit and the other indoor units, and a remote controller to give a setting signal for controlling the operation of the specified indoor unit to the specified indoor unit.

BRIEF DESCRIPTION OF THE DRAWINGS

The above and other objects, features and advantages of the present invention will be more apparent from the following description taken in connection with the accompanying drawings, in which.

DETAILED DESCRIPTION OF THE PREFERRED EMBODIMENTS

Figure 1:
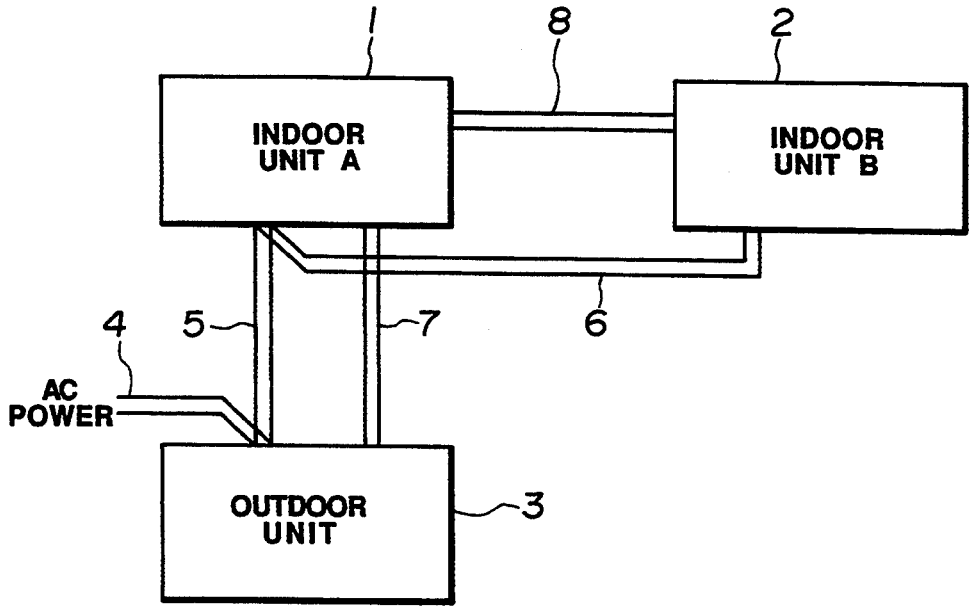
FIG. 1 is a system block diagram of an air conditioner showing an embodiment according to the present invention.

An embodiment according to a present invention will be explained based on the drawings in the following. FIG. 1 is a system block diagram of an air conditioner according to the present invention, and in the figure, reference numerals 1 and 2 denote indoor units (A) and (B) and they are provided in respective rooms to be air conditioned. Reference numeral 3 denotes an outdoor unit and it performs endothermic action or exothermic action from or to a heat source (for example, open air, water, etc.).

Reference numeral 4 denotes a power line to be used for supplying power from an AC power source to the outdoor unit 3. Reference numeral 5 denotes a power line to be used for supplying power to the indoor unit (A) 1 through the outdoor unit 3. Reference numeral 6 denotes a power line to be used for supplying AC power to the indoor unit (B) 2 through the outdoor unit 3 and the indoor unit (A) 1.

Reference numeral 7 denotes a signal line to be used for the transmission and reception of control signals between the indoor unit (A) 1 and the outdoor unit 3.

Reference numeral 8 denotes a signal line to be used for the transmission and reception of control signals between the indoor unit (A) 1 and the indoor unit (B) 2.

Figure 2:
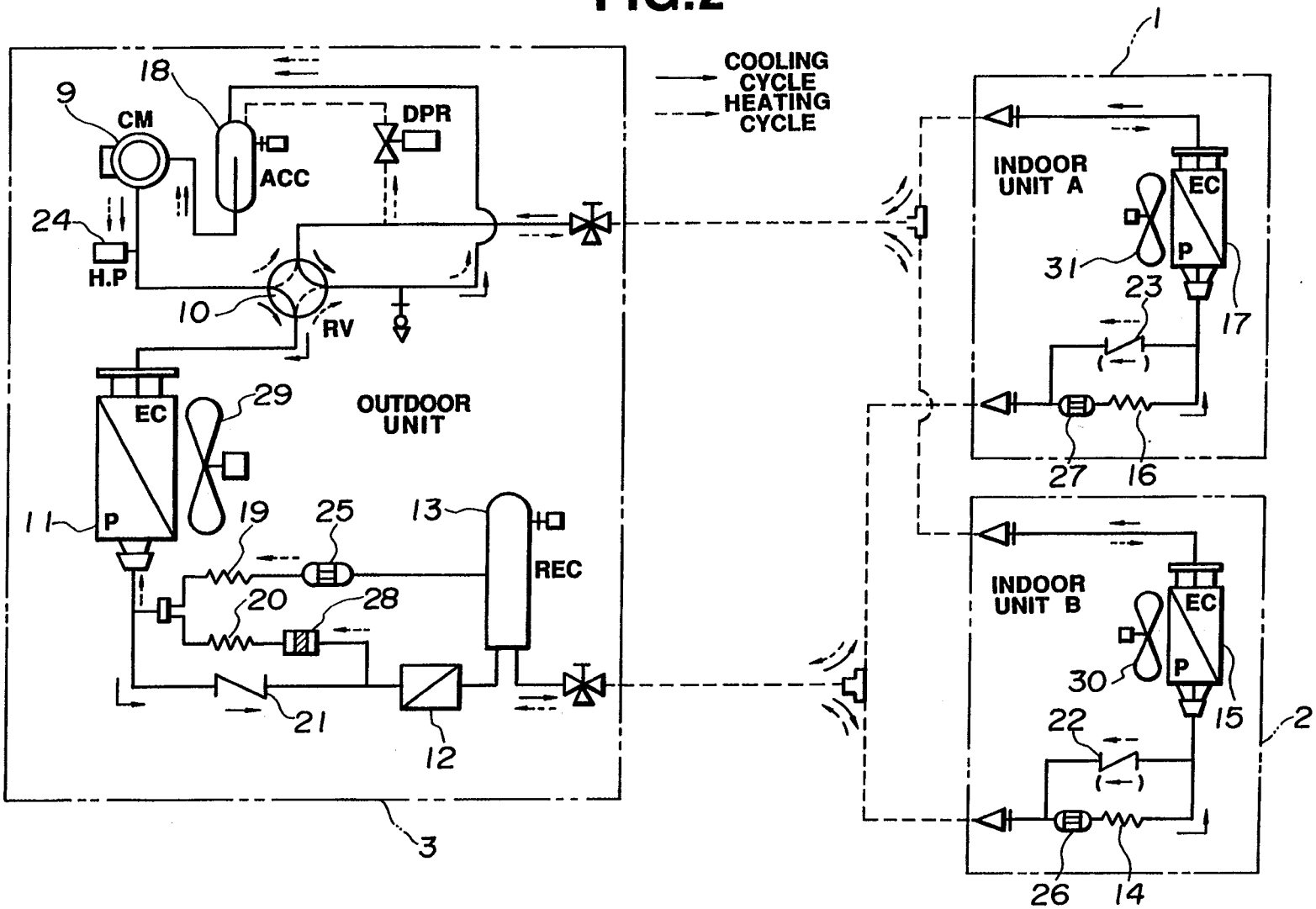
FIG. 2 is a refrigerant circuit diagram showing a refrigerating cycle of the air conditioner shown in FIG. 1.

FIG. 2 is a refrigerant circuit diagram showing the refrigerating cycle of the air conditioner shown in FIG. 1. Reference numeral 9 denotes a compressor, 10 denotes a four-way valve for changing the direction of flow of the refrigerant, 11 denotes an outdoor side heat exchanger, 12 denotes a freezing preventive heat exchanger provided in the lower part of the outdoor side heat exchanger 11, 13 denotes a receiver tank, 14 and 16 denote capillary tubes for a cooling mode, 15 and 17 denote indoor side heat exchangers, 18 denotes an accumulator, and 19 and 20 denote capillary tubes for a heating mode.

In the case of a cooling mode, the refrigerant discharged from the compressor 9 flows in a direction of an arrow described with a full line, the outdoor side heat exchanger 11 and the freezing preventive heat exchanger 12 act as condenser, and the indoor side heat exchangers 15 and 17 act as evaporator. For the capillary tubes 14 and 16, pressure reducing quantity is set to be able to obtain a proper evaporation temperature in the indoor side heat exchangers 15 and 17.

Reference numerals 21, 22 and 23 denote check valves, and the refrigerant can flow only in the direction shown by a full line arrow or a broken line arrow.

In FIG. 2, when the four-way valve 10 is switched to a broken line position the operation mode is switched to the heating mode. In the case of the heating mode, the refrigerant discharged from the compressor 9 flows in the direction of the broken line arrow, and the indoor side heat exchangers 15 and 17, and the freezing preventive heat exchanger 12 act as condensers, and the outdoor side heat exchanger 11 acts as the evaporator. The capillary tube 19 sets a pressure reducing quantity of the refrigerant branching from the receiver tank 13, and the capillary tube 20 sets a pressure reducing quantity of the refrigerant after passing through the freezing preventive heat exchanger 12.

Reference numeral 24 denotes a high pressure switch, 25, 26 and 27 denote strainers, and 28 denotes a drier. Reference numeral 29 denotes an outdoor fan driven by a motor, and 30 and 31 denote indoor fans driven by motors; the outdoor fan 29 expedites the heat exchange between the outdoor side heat exchanger 11 and the open air, and the indoor fans 30 and 31 expedite the heat exchange between the indoor side heat exchangers 15 and 17, and the air in the rooms.

Figure 3:
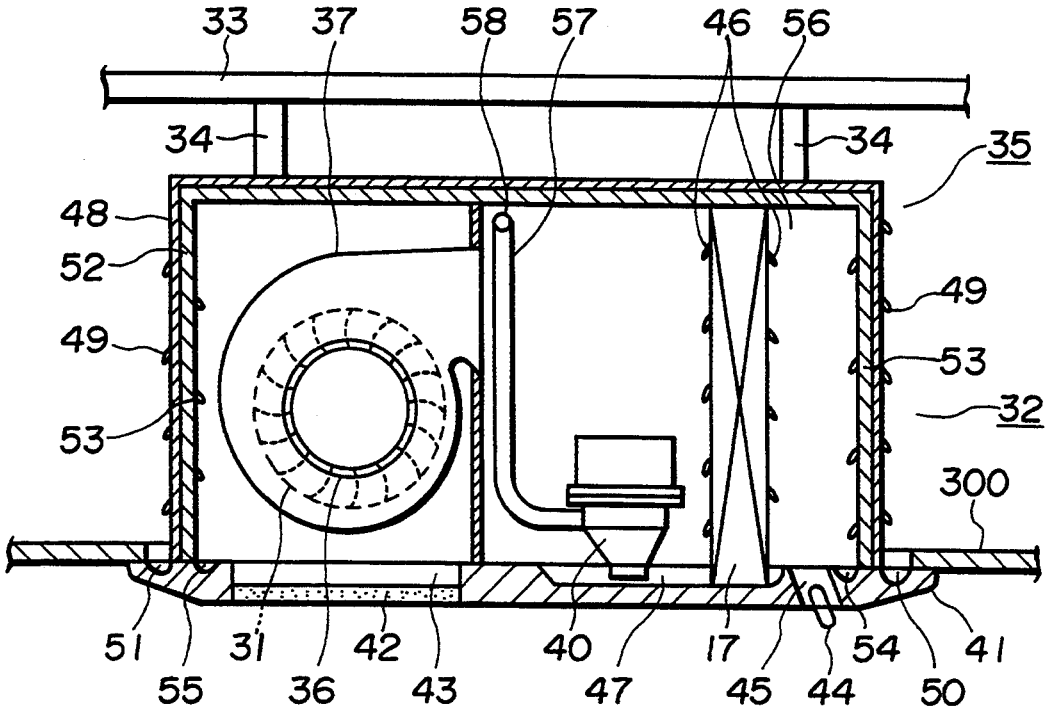
FIG. 3 is a sectional view of a principal part of an indoor unit when it is installed on a ceiling.

FIG. 3 is a sectional view of a principal part of the indoor unit(A) 1 (an indoor unit of a recessed ceiling type) when it is installed on a ceiling. In an internal space 32 of the ceiling 300, a main body 35 is provided being hung from a ceiling beam 33 with a hanger 34 comprises built-in parts as shown below: the indoor fan 31 being composed of a sirocco fan housed in a fan casing 37 having a suction nozzle 36, the indoor side heat exchanger 17, and a drain pump 40. A decorative panel 41 comprises: a suction port 43 with an air filter 42, a discharge port 45 having a flap 44, a main drain pan 47 for receiving condensed water 46 attached to the indoor side heat exchanger 17, an outside auxiliary drain pans 50 and 51 for receiving condensed dew water 49 attached to the outside wall of an outer casing 48 of the main body 35, and inside auxiliary drain pans 54 and 55 for receiving condensed dew water 53 attached to a heat insulator 52 of the outer casing 48, the inside auxiliary drain pans 54 and 55 which are formed into the body with the heat insulator 52 with an insulating material of urethane foam. The air of high temperature and humidity in the internal space 32 of the ceiling 300 is cooled by cold wind in the wind path 56 cooled by the indoor side heat exchanger 17 and the produced condensed dew water 49 and 53 attached to the outer wall on one side of the outer casing 48 and the insulator 52 is received by the auxiliary drain pans 50 and 54 on a side, and the air of high temperature and humidity in the internal space 32 of the ceiling 300 is cooled by the air inside the room cooled by air conditioning, and the produced condensed dew water 49 and 53 attached to the outer wall on the other side of the outer casing and the insulator 52 is received by the auxiliary drain pans 51 and 55 on the other side, and the condensed dew water 46, 49 and 53 is led to the main drain pan 47. The condensed dew water is pumped up by the drain pump 40 and discharged outdoors from the discharge port 58 through a discharge hose 57 together with the condensed dew water 46 attached to the indoor side heat exchanger 17 and received by the main drain pan 47.

As described in the above, the condensed dew water collected in the main drain pan 47 is once pumped up to a high place by the drain pump 40 and discharged, so that even if the main drain pan 47 is located at a low place, the discharge of condensed dew water can be performed easily.

FIG. 4 to FIG. 8 show electric circuit diagrams to be used for the indoor unit(A) 1 shown in FIG. 3. In the figures, 101 denotes a microprocessor (TMS73C161-C76582 of Texas Instruments Inc.) which controls the equipment based on a program previously stored in the internal ROM.

Reference numerals 102 and 103 denote interface circuits, and the interface circuit 102 performs transmission and reception of data to and from the indoor unit(B) 2, and the interface circuit 103 performs transmission and reception of data to and from the outdoor unit 3, and they have the same circuit constitution. The electric circuits of the interface circuit 102 and the interface circuit 103 will be explained in FIG. 7.

Reference numeral 104 denote a power supply circuit, and it generates DC voltages, +12 V and +5 V, from the AC power (AC 12 V) supplied through a terminal 105, and also generates a reset signal for resetting the microprocessor 101. Reference numeral 106 denotes a full-wave rectifier circuit in which 4 rectifier diodes are connected to form a bridge circuit. Reference numeral 107 denotes a smoothing capacitor and 108 is a capacitor for absorbing noise. A DC power of 12 V is obtained using the full-wave rectifier 106 and the smoothing capacitor 107.

Reference numeral 109 denotes an IC (integrated circuit) to be used for the control of a constant voltage circuit, and in which a transistor 114 is ON/OFF-controlled to make the voltage applied to a terminal VD a DC voltage of +5 V. Reference numeral 115 denotes a smoothing capacitor for stabilizing the DC +5 V. Reference numerals 111 and 112 denote resistors for dividing the DC +12 V. Reference numeral 113 denotes a capacitor for stabilizing the DC power to be supplied to the transistor 114. Reference numeral 118 denotes a bias resistor for the transistor 114. A reset signal is output from a terminal R of the IC 109. The reset signal is output after a specified period of time corresponding to a charging period of the capacitor 110 from the time when the voltage applied to the terminal VS is raised higher than a voltage necessary to stabilize the specified DC voltage of +5 V. The reset signal is given to the terminal R of the microprocessor 101 after it is amplified by transistors 116 and 117.

Reference numerals 119 to 124 denote bias resistors for transistors 116 and 117, and 125 and 126 denote output resistors for transistors 116 and 117. Reference numerals 127 and 128 denote capacitors.

Reference numerals 129, 130 and 131 denote thermistors whose internal resistance values are changed according to detected temperatures, and they are installed to be able to detect the air temperature discharged from the indoor unit(A) 1, the temperature of the indoor side heat exchanger 17, and the temperature in a room to be air conditioned. Reference numerals 130 to 141 denote resistors for linearizing the voltage changes corresponding to the resistance changes of the thermistors 129, 130 and 131, and the linearized respective voltage changes are given to the terminals A7, A1 and A0 of the microprocessor 101. The microprocessor 101 A/D-converts (analog/digital) the given voltages and stores them in an internal RAM as temperature data. Reference numerals 142 to 144 denote capacitors for absorbing noise.

Reference numeral 145 denotes an address setting switcher of 2 bits, and it is connected to the terminals C6 and C7 of the microprocessor 101 through diodes 146 and 147. The address is set being selected from 4 kinds of addresses constituted with the combination of the 2 bits. In the present embodiment, the operation of an air conditioner is performed in receiving wireless signals transmitted from a wireless remote controller (not shown in a drawing), so that the setting of the address is made to coincide with the destination address of the wireless signal to prevent a misoperation to be controlled by a different wireless remote controller.

Reference numeral 148 denotes a float switch, and its contact arm is closed when the quantity of condensed dew water collected in the main drain pan 47 shown in FIG. 3 is increased to a value more than a specified value. When the contact arm of the float switch 148 is closed, a transistor of a photo-coupler 149 is made ON. Therefore, diode 150 is short-circuited and +5 V is applied to a terminal H4 of the microprocessor 101. Reference numeral 151 denotes an output resistor of the photo-coupler 149. When the contact arm of the float switch 148 is opened, the transistor of the photo-coupler 148 is made OFF, so that a voltage lower than +5 V by 0.6 to 0.7 V (a forward direction voltage of the diode 150) is applied to the terminal H4 of the microprocessor 101. A specified differential is set for the open/close operation of the contact arm of the float switch 148 to prevent the chattering of the contact arm.

Figure 5:
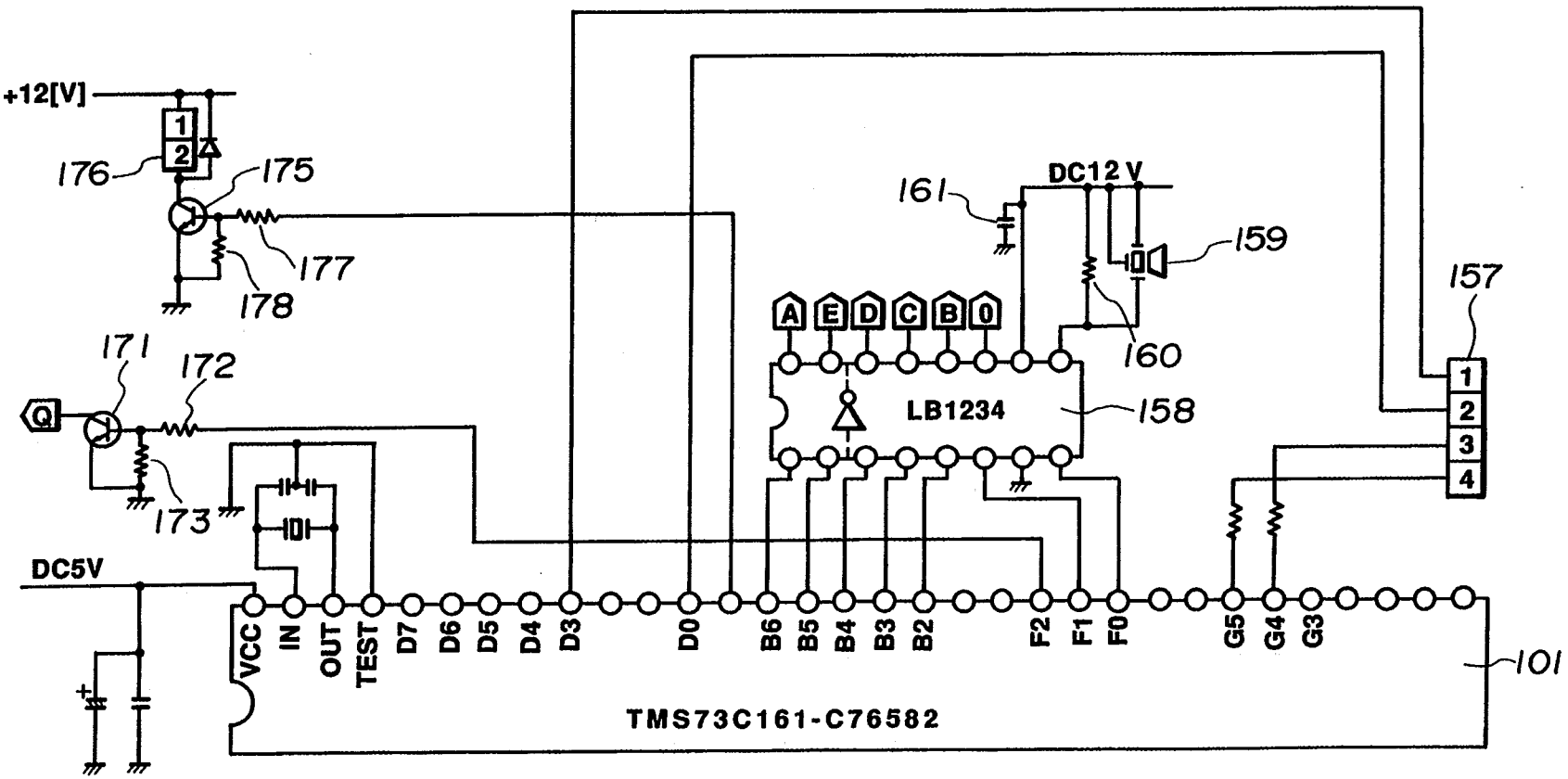
FIG. 5 is an electric circuit diagram to be used for the indoor unit shown in FIG. 3.
Figure 8:
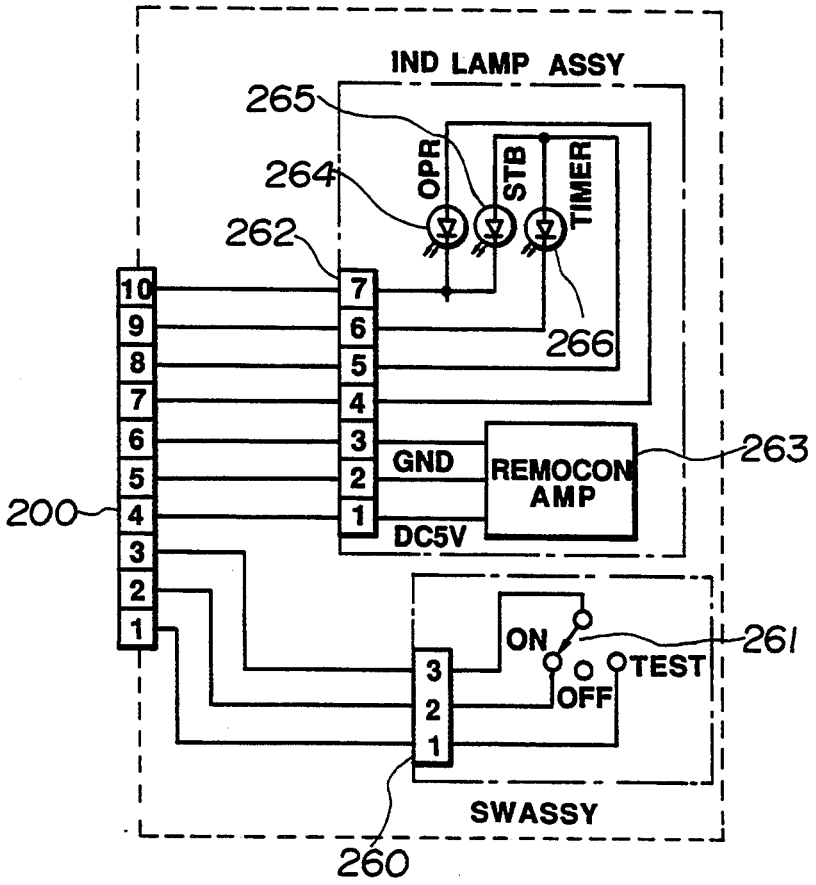
FIG. 8 is an electric circuit diagram to be used for the indoor unit shown in FIG. 3.

Reference numeral 152 denotes a connector being connected to a sub-circuit shown in FIG. 8, and a connector 153 are connected to a connector 157 shown in FIG. 5 in a manner that the terminals on both sides having the same numbers are connected to each other. Reference numerals 154 and 156 denote diodes which regulate the direction of flow of signals from the microprocessor 101. Reference numeral 156 denotes a resistor.

Switches SW1 and SW2 regulate the operation in a heating mode as described in the following: when SW1 is OFF and SW2 is OFF, only the operation in heat pump cycle is operated, when SW1 is ON and SW2 is OFF, an auxiliary heater is in existence, and when SW1 is OFF and SW2 is ON, the auxiliary heater is not in existence and the operation in heat pump cycle is stopped.

In FIG. 5, the terminals G4 and G5 of the microprocessor 101 are connected to a connector 157. Reference numeral 158 denotes an IC on which a plurality of buffer circuits are mounted, and the IC power-amplifies the outputs from the terminals F0, F1, F2, and B2 to B6 of the microprocessor 101. A speaker 159 is driven by the output from the terminal F0, and gives an alarm sound, etc.

Figure 6:
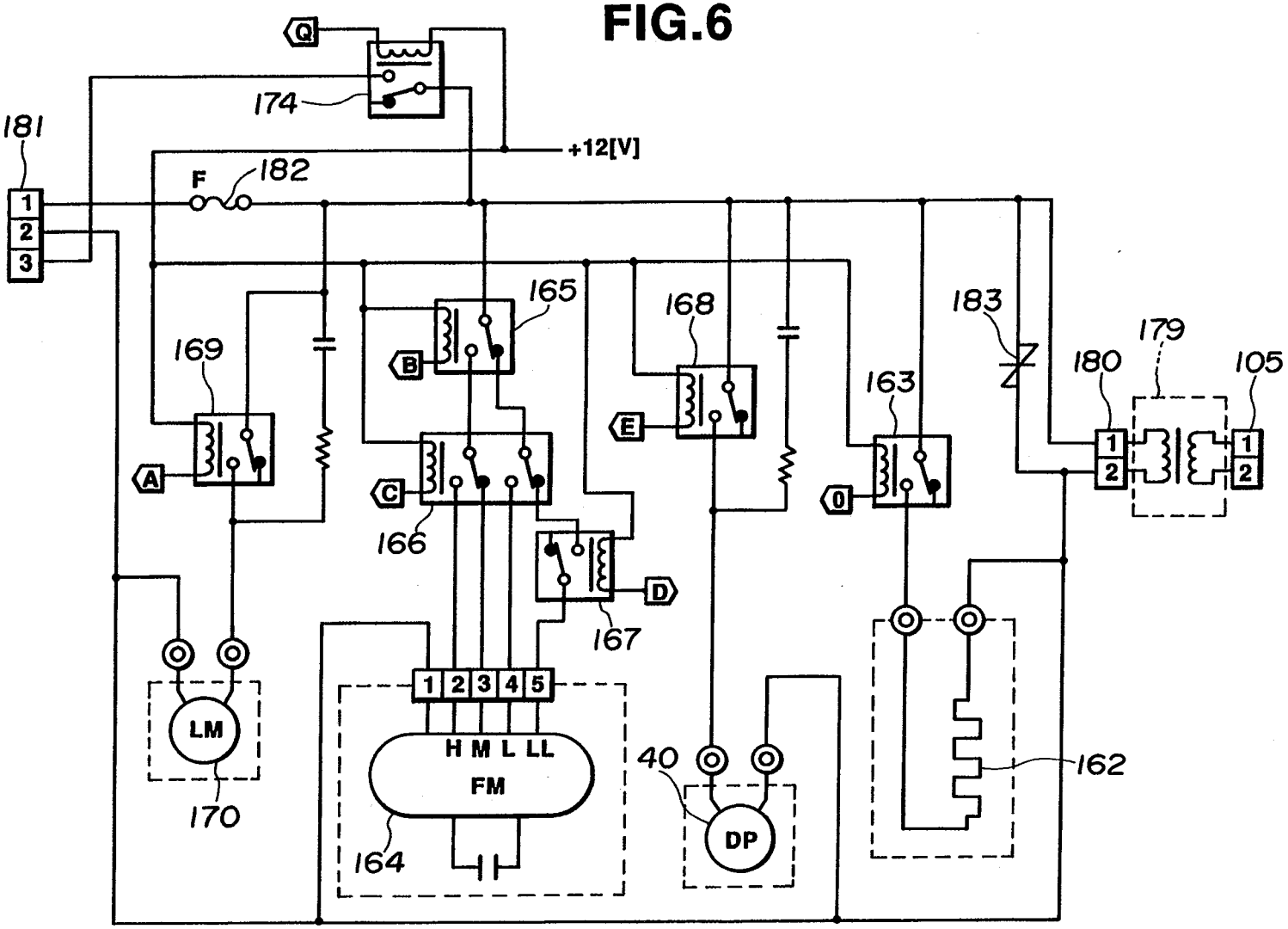
FIG. 6 is an electric circuit diagram to be used for the indoor unit shown in FIG. 3.

The outputs from the terminals F1, B2 to B6 of the microprocessor 101 are power-amplified by the IC 158 and then supplied to terminals O, B, C, D, E and A respectively as shown in FIG. 6. The terminal O outputs a signal which controls the operation of a relay 163 for energizing an auxiliary heater 162, the terminal B outputs a signal which controls the operation of a relay 165 for adjusting the speed of an indoor side fan motor 164, the terminal C, in a similar way to the above, outputs a signal which controls the operation of a relay 166 for adjusting the speed of a fan, the terminal D, in a similar way to the above, outputs a signal which controls the operation of a relay 167 for adjusting the speed of the fan motor, the terminal E outputs a signal which controls the operation of a relay 168 for energizing the drain pump 40, and the terminal A outputs a signal which controls the operation of a louver motor 170 (flap 44).

Reference numeral 171 shown in FIG. 5 denotes a switching transistor, and it is controlled to make ON/-OFF corresponding to a signal from the microprocessor 101. When the transistor 171 is made ON, a relay 174 is made ON shown in FIG. 6 through a terminal Q. Reference numerals 172 and 173 denote bias resistors for the transistor 171.

Figure 15:
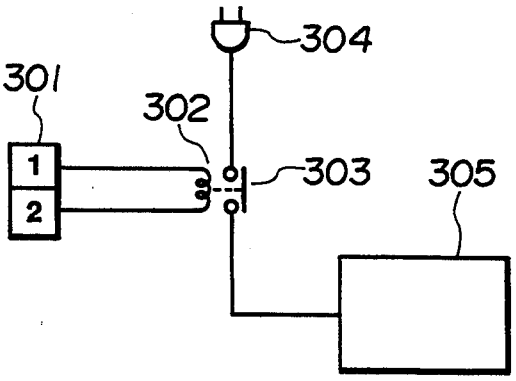
FIG. 15 is an electric circuit diagram of an electric heater as the other heater.

Reference numeral 175 denotes a switching transistor, and it is controlled to make ON/OFF corresponding to a signal from the microprocessor 101. A connector 301 shown in FIG. 15 is connected to a connector 176. An electric heater 305 to be used for an auxiliary heat source as an other heater and an auxiliary relay 302 to open/close a switch 303 provided between the heater 305 and the convenience outlet 304 are connected to the connector 301, and the energizing of the electric heater 305 is controlled by the ON-OFF of the transistor 175. Reference numerals 177 and 178 denote bias resistors for the transistor 175.

Figure 4:
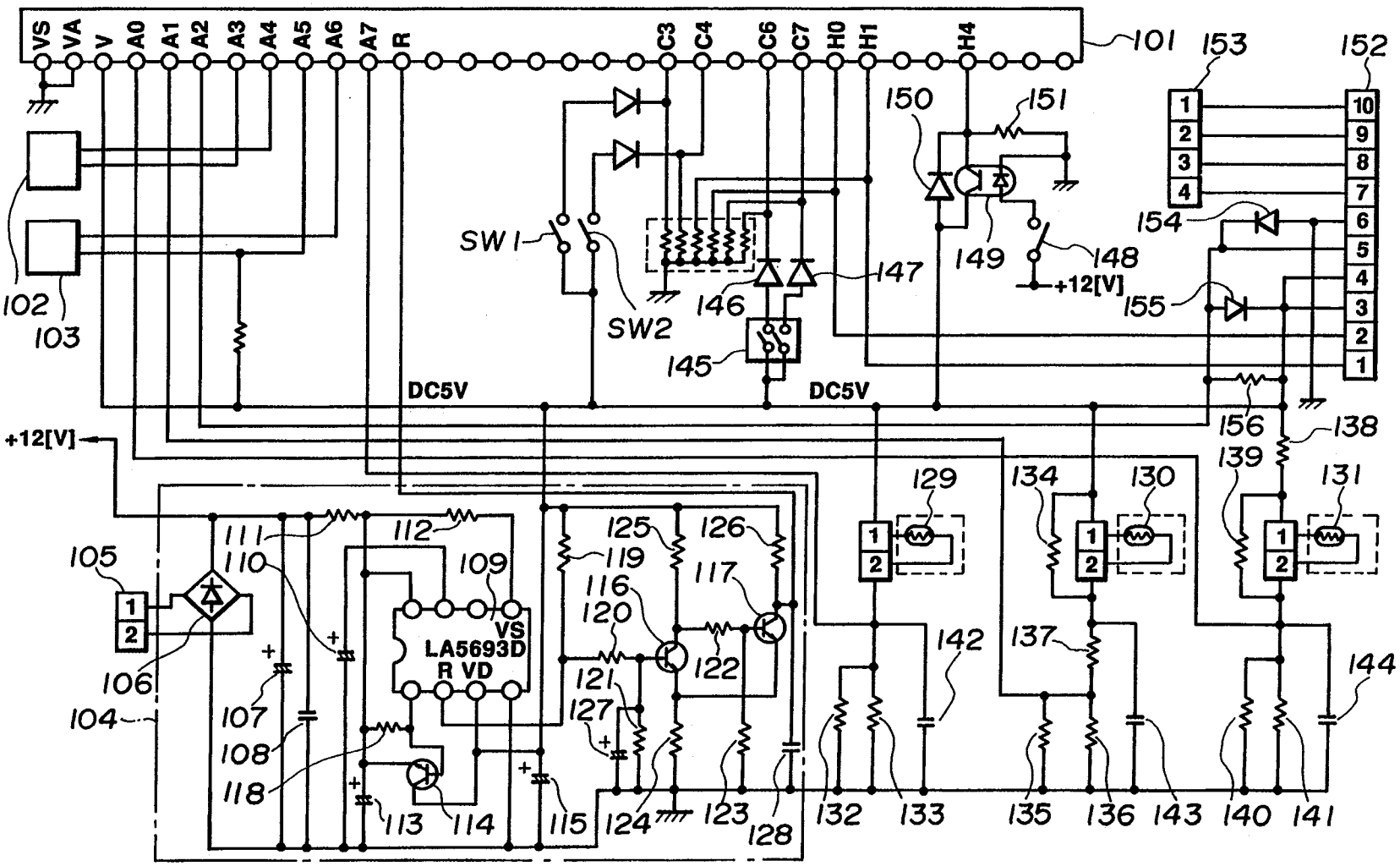
FIG. 4 is an electric circuit diagram to be used for the indoor unit shown in FIG. 3.

In FIG. 6, 179 is a step-down transformer, and it lowers the voltage of the AC power obtained through a connector 180 and a connector 181, and supplies the power to the power line 104 shown in FIG. 4 through the connector 105. AC power is supplied between the terminals 1 and 2 of the connector 105 from the outdoor unit 3. When a normally opened contact arm of the relay 174 is closed, (FIG. 6 shows a state where the contact arm is opened; the closed state is an opposite state to the state shown in the figure.), AC power is supplied from terminals 2 and 3 of the connector 181. AC power is supplied to the indoor unit(B) 2 through the terminals 2 and 3. Reference numeral 182 denotes a current fuse, and 183 denotes a varistor.

When a signal is given to relays 163, 168 and 169, a normally opened contact arm of the relay 163 is closed, a normally opened contact arm of the relay 168 is closed, and a normally opened contact arm of the relay 169 is closed.

The number of revolutions of the indoor side fan motor 164 is changed according to the combinations of open/close of the normally opened contact arms of relays 165, 166 and 167 as shown below: (1) when relay 165: opened (a state shown in the figure), relay 166: opened (a state shown in the figure), and relay 167: opened (a state shown in the figure), motor: stopped; (2) relay 165: opened, relay 166: opened, relay 167: closed, motor: very weak rotation; (3) relay 165: opened, relay 166: closed, motor: weak rotation; (4) relay 165: closed, relay 166: opened, motor: medium rotation; (5l) relay 165: closed, relay 166: closed, motor: strong rotation. The open/close of the relays 165, 166 and 167 are controlled by the signals from the microprocessor 101; thereby the number of revolutions of the indoor side fan motor 164 is controlled by the signals from the microprocessor 101.

Figure 7:
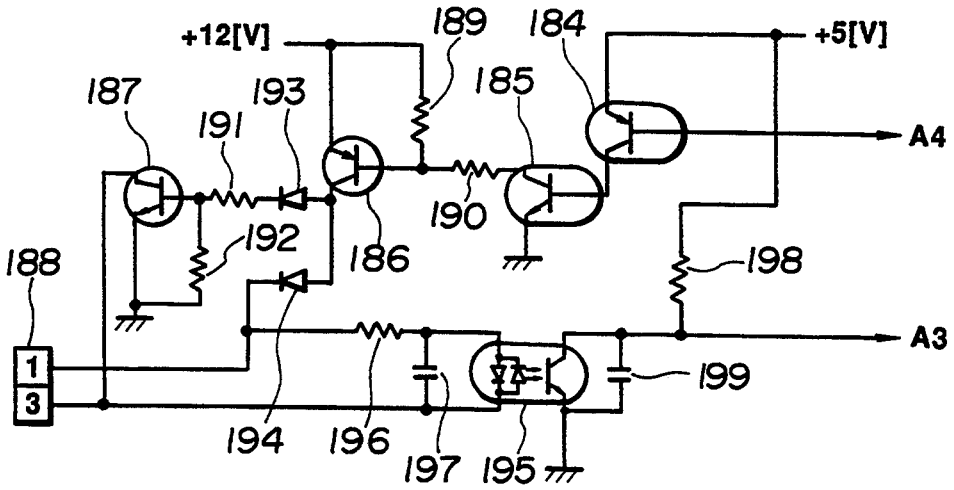
FIG. 7 is an electric circuit diagram to be used for the indoor unit shown in FIG. 3.

FIG. 7 is an electric circuit diagram of the interface circuit 102 shown in FIG. 4. Reference numerals 184 to 187 denote switching transistors, and when a base terminal of the transistor 184 (output of the terminal A4 of the microprocessor 101) is at a low voltage L (almost 0 V), all transistors 184 to 187 are made ON (conductive state). Therefore, at this time, a voltage of +12 V is applied to the terminal 1 of the connector 188, and at the same time the terminal 2 of the connector 188 is made to GND (0 V).

When the base terminal of the transistor 184 is at a high voltage H (about 5 V), all transistors 184 to 187 are made OFF. Therefore, it is possible to make switching of a voltage of +12 V applied between terminals 1 and 2 of the connector 188 corresponding to the output (H/L) of the terminal 4 of the microprocessor 101. A voltage signal PWM modulated by the switching is transmitted to the indoor unit(B) 2 through the signal line 8 to be connected to the connector 188. Reference numerals 189 to 192 denote bias resistors, and 193 and 194 denote diodes to regulate the direction of flow of an electric current.

Reference numeral 195 denotes a both-way photo-coupler, and 196 and 197 denote a resistor and a capacitor for constituting a noise filter. An input terminal of the photo-coupler 195 is connected to the connector 188 through the noise filter, and when a DC voltage is applied to the connector 188 an output transistor is made ON, and the terminal A3 is made to be at a low voltage L (almost 0 V).

Therefore, when the output of the terminal A4 of the micro-processor 101 is at an H voltage, if a voltage (a voltage signal transmitted from the indoor unit 2) is applied to the connector 188, the terminal A3 of the microprocessor 101 is made to be at a voltage L. Since the potential of the terminal A3 is varied from H to L or vice versa corresponding to the voltage signal applied to the connector 188, the microprocessor 101 can input a signal from the indoor unit(B) 2.

Reference numeral 198 denotes an output resistor of the photo-coupler 195, and 199 denotes a capacitor for absorbing noise.

The interface circuit 103 has a similar electric circuit and makes similar operations to the interface 102 shown in FIG. 7, so that the explanation will be omitted. Different points of the interface circuit 103 from the interface circuit 102 are as shown below: the base terminal of the transistor 184 is connected to the terminal A6 of the microprocessor 101, the output of the photo-coupler 195 is connected to the terminal A5 of the microprocessor 101, and the connector 188 is connected to the outdoor unit 3 through the signal line 7.

FIG. 8 is an electric circuit diagram to be connected to the electric circuit shown in FIG. 4, and the connector 152 and a connector 200 shown in FIG. 4 are connected in a manner that the terminals on both sides having the same numbers are connected to each other.

The terminals 1 to 3 of the connector 200 are connected to a selection switch 261 through a connector 260. The selection switch 261 has following positions to be selected: ON (a position at which normal operation is possible), OFF (a position at which operation is impossible), and TEST (a position for a trial operation). The position of the switch is taken in by the microprocessor 101 by scanning with the terminals A2, H0 and H1.

The terminals 4 to 6 of the connector 200 are connected to a remote control signal receiving portion 263 through a connector 262. When change over signals of operation/stop or cool/heat/dry, a draft quantity setting signal for the indoor fan, a signal showing a room temperature set value, etc. are transmitted from a remote controller (not shown in a drawing) in wireless to the remote control signal receiving portion 263, it receives the wireless signals and demodulates them and outputs to the terminal A2 of the microprocessor 101.

Reference numerals 264 to 266 denote indicator lamps, and the indicator lamp 264 is a cool wind prevention indicator (It is made ON when the blowout of cool wind is prohibited in a heating operation.), the indicator lamp 265 is a standby indicator (It is made ON when the operation of a compressor is stopped because of a too low temperature of the open air.), and the indicator lamp 266 is a timer indicator (It is made ON when timer operation is performed.) and they are made to do dynamic ON by the outputs of the terminals, G4, G5, D0 and D3, of the microprocessor 101.

The indoor unit(B) 2 and the indoor unit(A) 1 have similar control circuits to each other but the former does not comprise an interface circuit for performing transmission or reception of signals to or from the outdoor unit 3 and a demodulator circuit for receiving wireless signals. The setting by the address switch 145 is "00" which designates the unit to be the indoor unit(B) 2 for the microprocessor 101.

Figure 9:
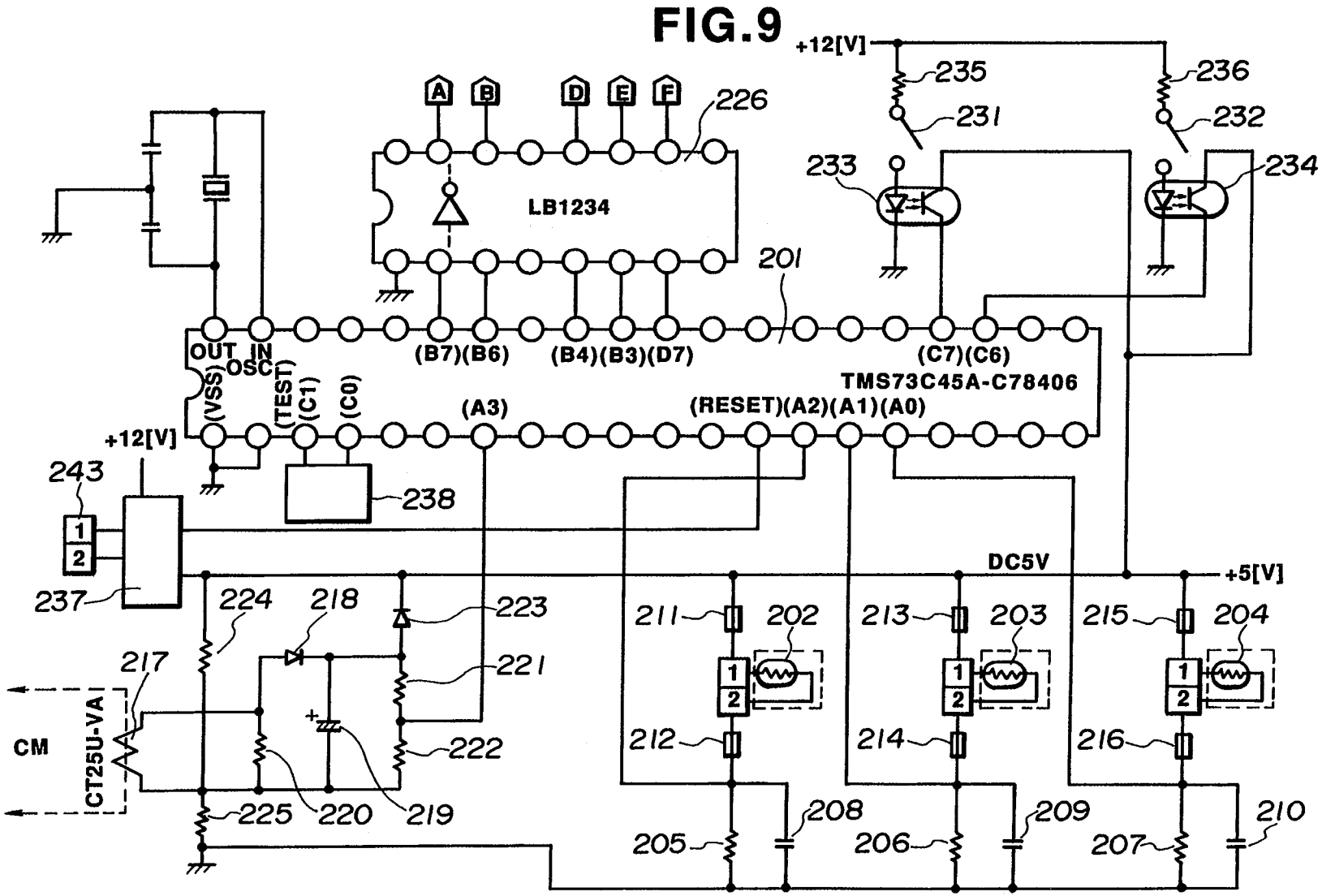
FIG. 9 is an electric circuit diagram to be used for the outdoor unit shown in FIG. 1.

FIG. 9 is an electric circuit diagram of a control portion as an outdoor control means which takes charge of the operation of the outdoor unit 3 shown in FIG. 1. In the figure, 201 denotes a microprocessor (TMS73C45A-C78406 of Texas Instruments Inc.) which controls various kinds of units based on a program previously stored in the internal ROM.

Reference numerals 202 to 204 denote thermistors for detecting temperatures, and the internal resistances vary corresponding to detected temperatures. Reference numerals 205 to 207 denote resistors, and they are connected to respective thermistors 202 to 204 in series. Therefore, the potential of each connecting point of a thermistor and a resistor is varied corresponding to a detected temperature by the thermistor. These connecting points are connected to the terminals, A2, A1 and A0, of the microprocessor 201. The micro-processor 201 A/D-converts the voltages applied to the terminals, A2, A1 and A0, and takes them in and stores them in the internal RAM as temperature data.

Thermistor 202 detects the temperature of the compressor 9, the thermistor 203 detects the temperature of the outdoor side heat exchanger 11, and the thermistor 204 detects the temperature of the open air.

Reference numerals 208 to 210 denote capacitors for stabilizing the voltages of connecting points corresponding to detected temperatures by thermistors. Reference numerals 211 to 216 denote ferrite beads having cylinder shapes, and they are provided on the wirings connecting respective thermistors 202 to 204 and electric circuits (Wirings pass through the holes of the beads.). These ferrite beads attenuate high frequency noise which will come into thermistors 211 to 216. These ferrite beads combined with capacitors 208 to 210 cut off the noise.

Reference numeral 217 denotes a current transformer (CT), and the search coil is provided on a power line which supplies power to the compressor 9 for detecting the power to be supplied to the compressor 9. Reference numeral 220 denotes an output resistor of the CT 217, and 218 and 219 denote a rectifier diode and a smoothing capacitor which constitute a smoothing circuit for smoothing out the output of the CT 217.

Reference numerals 221 and 222 denote voltage divider resistors which divide the DC voltage output from the smoothing circuit and a divided voltage is supplied to the terminal A3 of the microprocessor 201. The microprocessor 201 A/D-converts the DC voltage applied to the terminal A3, and stores it as the current data of the compressor 9. Reference numeral 223 denotes a diode for protection and constitutes a by-pass circuit when the output voltage of the smoothing circuit rises higher than $+5\ V+0.6$ to $0.7\ V$ (a forward voltage of a diode). Resistors, 224 and 225, are resistors for boosting the output of the CT 217.

Figure 10:
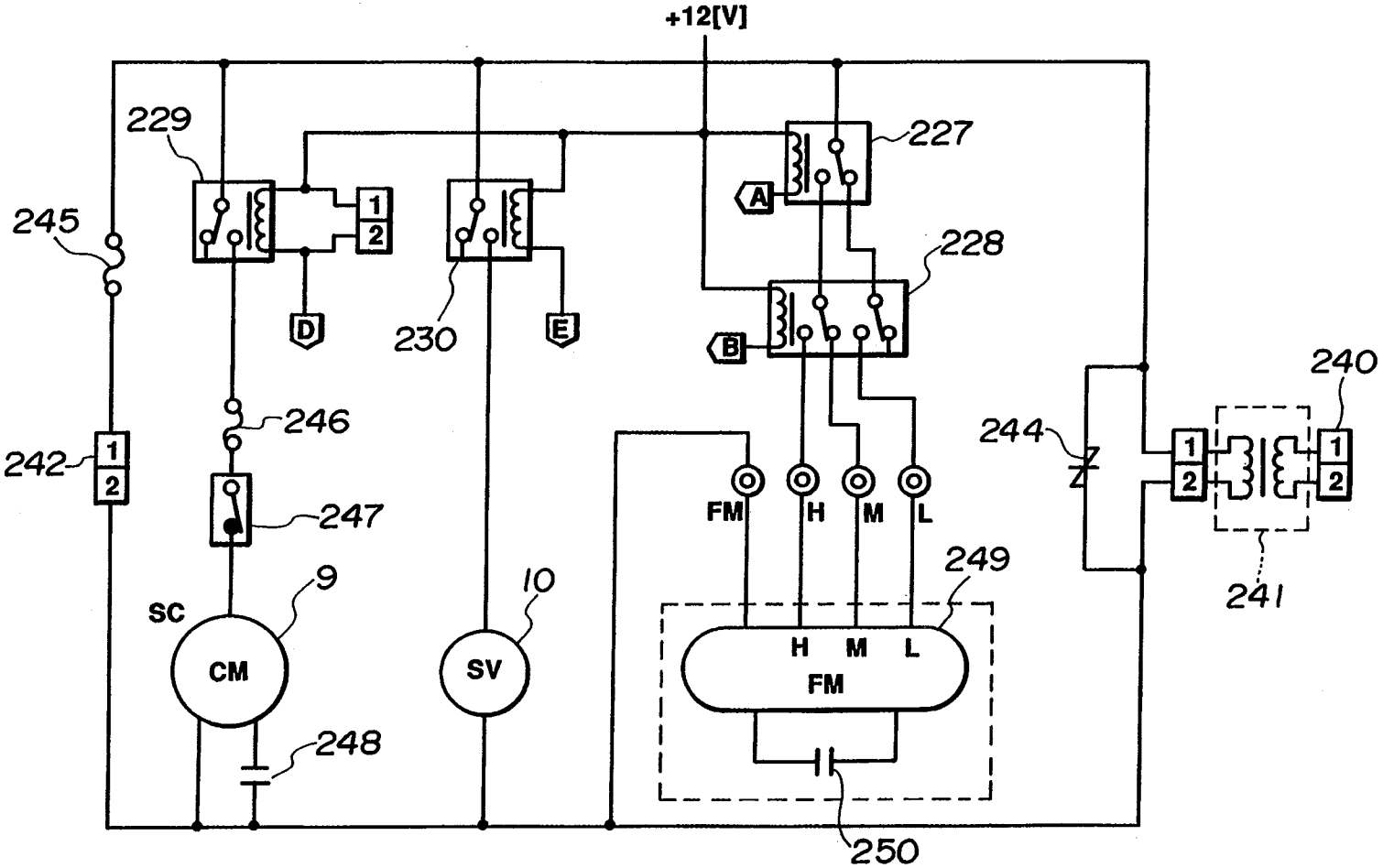
FIG. 10 is an electric circuit diagram to be used for the outdoor unit shown in FIG. 1.

Reference numeral 226 denotes a buffer circuit, and it power-amplifies the signals output from the terminals B7, B6, B4, B3 and D7 of the microprocessor 201 for driving the respective relays 227 to 230 shown in FIG. 10. The terminal D7 is an external output terminal.

Reference numerals 231 and 232 denote a high voltage switch and a low voltage switch, and the high voltage switch closes its contact arm when the discharge pressure of the compressor 9 is raised not less than a first pressure, and the low voltage relay closes its contact arm when the suction pressure of the compressor 9 is not more than a second pressure (less than the first pressure). Reference numerals 233 and 234 denote photo-couplers and they are energized respectively when the high pressure switch and the low pressure switch are operated, and they output signals to the terminals C7 and C6 of the microprocessor 201. Reference numerals 235 and 236 denote current limiting resistors for the photo-couplers 233 and 234.

Reference numeral 237 denotes a power supply circuit, and it is the same electric circuit as the power supply circuit 104 shown in FIG. 4. Reference numeral 238 denotes an interface circuit, and it is the same electric circuit as those of the interface circuits 102 and 103 shown in FIG. 4. The interface circuit 238 is connected to the interface circuit 103 of the indoor unit(A) 1 through the signal line 7, and also it is connected to the terminals C1 and C0 of the microprocessor 201, which makes it possible to perform the transmission or reception of signals between the indoor unit(A) 1 and the outdoor unit 3.

FIG. 10 is a control circuit for a motor 249 which drives the compressor 9, the four-way valve 10, and the outdoor fan 29. A connector 240 is connected to the connector 243 shown in FIG. 9, and the AC power supplied to a connector 242 is given to a step-down transformer 241. Reference numeral 244 denotes a varistor, and 245 denotes a current fuse.

Power is supplied to the compressor 9 through a normally opened contact arm of the relay 229 (A state where the relay 229 is not energized is shown in the figure.), a temperature fuse 246 which is melted when the temperature of the compressor 9 is raised to a high temperature, and an overload switch 247 which opens its contact arm when the current supplied to the compressor is increased more than a specified value. Reference numeral 248 denotes an operation capacitor for the compressor 9.

Power is supplied to the four-way valve 10 through a normally opened contact arm of the relay 230 (In the figure, there is shown a state where the relay is not energized.).

The number of revolutions of the motor 249 is switched over based on the states of the relay 227 and the relay 228 whether they are energized or not. In the figure, the states where the relays 227 and 228 are not energized are shown. When the relays 227 and 228 are not energized, the motor 249 is stopped, when the relay 227 is not energized and the relay 228 is energized, the motor 249 is rotated at a low speed, when the relay 227 is energized and the relay 228 is not energized, the motor is rotated at a medium speed, and when both relays 227 and 228 are energized, the motor is rotated at a high speed. Reference numeral 250 denotes an operation capacitor for the motor 249.

Figure 11:
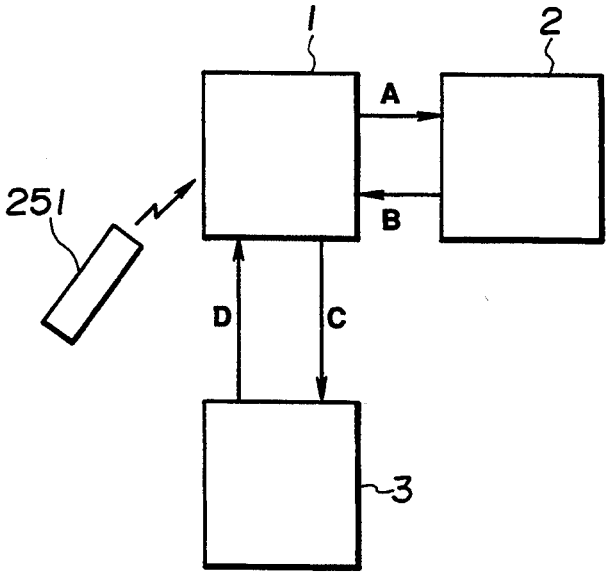
FIG. 11 is an illustrative representation showing the flow of signals among the indoor unit (A), the indoor unit (B) and the outdoor unit.

FIG. 11 is an illustrative representation showing the flow of signals among the indoor unit(A) 1, the indoor unit(B) 2, and the outdoor unit 3. The transmission and reception of signals among the respective units are performed through the respective interface circuits.

Reference numeral 251 denotes a wireless remote controller, and the control signals are transmitted to the remote control signal receiving portion 263 of the indoor unit(A) 1. From the indoor unit(A) 1 to the indoor unit(B) 2, signals expressed with A are transmitted; from the indoor unit(B) 2 to the indoor unit(A) 1 signals expressed with B are transmitted; from the indoor unit(A) 1 to the outdoor unit 3, signals expressed with C are transmitted; and from the outdoor unit 3 to the indoor unit(A) 1, signals expressed with D are transmitted.

The signals expressed with A are those concerning operation data as shown in the following: the ON/OFF signals (It can be replaced with data, and it is applicable to the following items.), the operation mode signals (COOL/HEAT/DRY), the indoor wind speed signals (H, M, L, or AUTO), the control signals for the auto louver, the defrosting signal, the indoor temperature setting signal, the operation signals for the drain pump, etc. The indoor unit(B) 2 is operated based on these signals.

The signals expressed with B are those to be used when protective operations are needed as shown in the following: a signal when the water level in the main drain pan becomes high, a lock signal for the indoor fan (A state of lock is judged when the temperature detected by the thermistor 129 shown in FIG. 4 becomes higher than a specified range.), a freezing signal of the indoor side heat exchanger 15 in a cooling operation (The freezing state of the indoor side heat exchange 15 is judged when the detected temperature by the thermistor 130 shown in FIG. 4 is lower than or equal to $-1°$ C.), a heavy load operation signal in a heating operation (The heavy load operation is judged when the detected temperature by the thermistor 130 shown in FIG. 4 is higher than or equal to +59° C.), etc.

Therefore, the indoor unit(B) 2 is operated based on the signals from the indoor unit(A) 1, and when a trouble which needs protective operation occurs in the indoor unit(B) 2, the signal is transmitted from the indoor unit(B) 2 to the indoor unit(A) 1.

The signals expressed with C are those as shown in the following: ON/OFF signals of the compressor 9, ON/OFF signals of the four-way valve, the freezing signal of the indoor side heat exchanger, the heavy load signal of the indoor unit, and the defrosting signal.

The signals expressed with D are those as shown in the following: the signal expressing the open air temperature, the defrosting signal, the signal from the high pressure switch 231, the signal from the low pressure switch 232, and the current signal which flows in the compressor 10.

The defrosting operation is started by the lowering tendency of the indoor side heat exchangers 15 and 17 or by the relation between the temperature of the outdoor side heat exchanger 11 and that of the open air.

Figure 12:
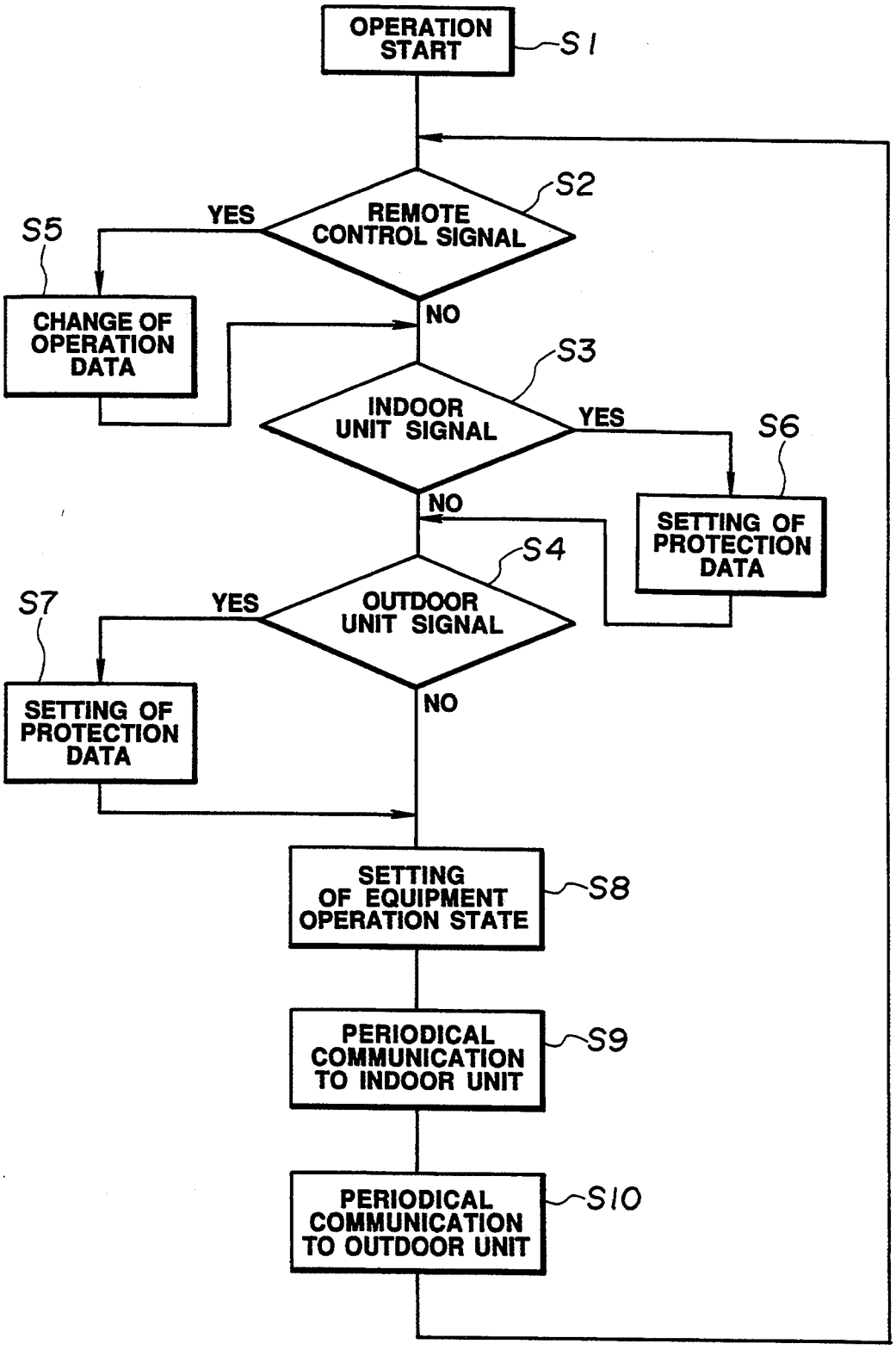
FIG. 12 is a flow chart showing principal operations of the indoor unit (A).

FIG. 12 is a flow chart showing the principal operations of the indoor unit(A) 1. In step S1, the operation is started after the signal resetting and the initializing process of the microprocessor 101 which are performed by the signal from the power supply circuit. In step S2, it is judged whether the wireless signal from the wireless remote controller 251 is being received or not. When the wireless signal is received, the microprocessor 101 is interrupted and the received signal data are stored in a specified RAM area. When the wireless signal is received, the process is advanced to step S5. In step S3, it is judged whether the signal from the indoor unit(B) 2 is being received or not (A plurality of indoor units can be connected when the units are connected in parallel for the signal line 8.). When the signal from the indoor unit(B) 2 is received, the microprocessor is interrupted and the data of the signal from the indoor unit(B) 2 are stored in the specified RAM area. When data are stored in the RAM area, the process is advanced to step S6. In step S4, it is judged whether the signal from the outdoor unit 3 is being received or not. The signal from the outdoor unit 3 is also stored in the specified RAM area similar to the signal from the indoor unit(B) 2. When data are stored in the RAM area the process is advanced to step S7. There is no duplication of data in the RAM areas where respective receiving signals are stored.

In step S5, operational data are changed based on the signals transmitted from the wireless remote controller 251. The operational data of the air conditioner are as shown in the following: operational data of stop/operation/off-timer-operation/on-timer-operation, operational time data of a timer, operational mode data such as cooling/heating/dry/AUTO, room temperature setting data, operational data of the indoor fan such as H/M/L/AUTO, or control data for the auto louver. In step S8 based on these operational data, the operation control of the equipment (motor 164, louver motor 170, the drain pump DP40, etc.), the setting of states such as operation/stop of the compressor 9 and energizing/stop of energizing of the four-way valve, etc. are performed.

In step S6, the setting of protective data is performed based on the signal transmitted from the indoor unit(B) 2. In step S8, the setting of the operation of the equipment or the setting of operational states is changed based on the protective data. The protective data are also set when a trouble occurs in the indoor unit(A) 1. For example, when the data expressing that the water level in the main drain pan 47 is high are set, the driving of the drain pump 40 is set till the water level in the main drain pan 47 is lowered enough and the stop of operation of the compressor 9 is also set.

In step S7, the setting of protective data is performed based on a signal transmitted from the outdoor unit 3. A defrosting signal from the outdoor unit 3 is included in the protective data. In step S8, the operation of the equipment or the setting of operational states is changed based on the protective data. For example, when the defrosting signal is set, the motor 164 is operated in a very weak state (LL) to prevent the blowing off of cooled air. In the defrosting operation, the four-way valve 10 is changed to the cooling mode.

In step S9, the signals which indicate the operational states of the equipment being operated in step S8 (signals A shown in FIG. 11) are transmitted to the indoor unit(B) 2. (The confirmation of the transmitted data is made by the answer-back from the indoor unit(B) 2.) The transmission of the signal is performed every 4 sec. periodically.

In step S10, a signal for setting the operational states of the equipment which are changed in step S8 (ON/OFF of the compressor 9, etc.) is transmitted to the outdoor unit 3. The transmission of the signal is performed every 4 sec. periodically, and in the periodical communication, the protective data expressed by D are returned from the outdoor unit 3 to the indoor unit(A) 1.

As described in the above, the operational states (the room temperature setting value, the operation mode, the setting value of the indoor fan, etc.) set by the remote controller in the indoor unit(A) 1 are transmitted to the indoor unit(B) 2; thereby, it is made possible to set the operations of a plurality of indoor units simultaneously by a single wireless remote controller, which makes the control of the air conditioner easy. Troublesomeness such as the address setting of every indoor unit, or the selection of the remote controller corresponding to every indoor unit is eliminated. When the number of revolutions of the motor 164 is set at AUTO, it is programmed in the microprocessor that the draft quantity of each indoor unit is automatically changed based on the room temperature and the set temperature, so that comfortable draft is performed by every indoor unit. When the operation is in an AUTO mode, the setting of the room temperature is also, similar to the draft quantity, automatically performed in every indoor unit. The ON/OFF of the compressor 9 is controlled according to the setting of the indoor unit(A) 1.

The signal concerning protective data shown by B in FIG. 11 is transmitted from every indoor unit, so that when a trouble occurs in an indoor unit, the indoor unit(A) 1 executes the control of the outdoor unit 3 and performs protective operations for the trouble.

Figure 13:
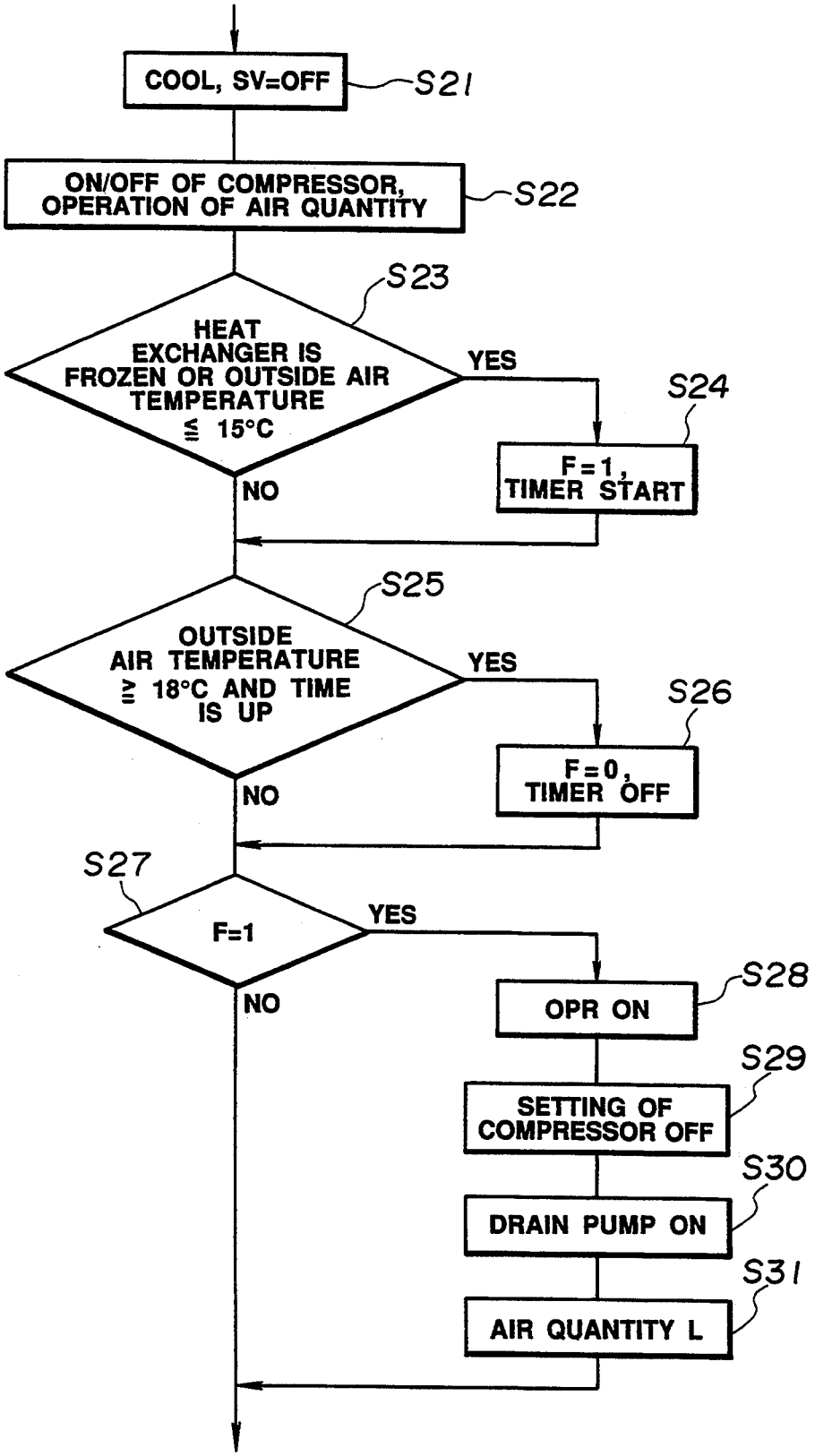
FIG. 13 is a flow chart showing a part of the operations, especially, in cooling operation in step S8 shown in FIG. 12.

FIG. 13 is a flow chart showing the operation in the cooling mode in step S8 shown in FIG. 12. In step S21 the states of the equipment (the ON/OFF of the four-valve (SV) 10, etc.) are set to make the indoor units and the outdoor unit operate in the cooling mode. In step S22, when a temperature detected by the thermistor 131 is higher than the set temperature, the ON/OFF state of the compressor 9 is set to be ON. The ON state of the compressor 9 is continued at least for 3 minutes and the OFF state is also continued at least for 3 minutes, to secure the least cooling operation period of time and to prevent the lock at the restarting of the compressor 9.

The draft quantity is set based on the difference between the room temperature detected by the thermistor 131 and the set temperature. The draft quantity is set based on each room temperature detected by each indoor unit.

In step S23, it is judged that whether the indoor side heat exchangers 17 and 15 are frozen or not (It is judged that if the temperature of the indoor side heat exchanger 17 or 15 is below or equal to −1° C., and protective data are transmitted from the indoor unit(B) 2.), and that whether the open air temperature detected by the thermistor 204 of the outdoor unit 3 is below or equal to 15° C. or not, and when at least one of the above conditions is satisfied, the process is advanced to step S24.

In step S24, a flag F is set at F=1, and the timer watch is started.

In step S25, it is judged that whether the open air temperature detected by the thermistor 203 of the outdoor unit 3 is higher than or equal to +18° C. or not, and that the operation of the timer watch started in step S24 is completed (for 12 minutes) or not. When both conditions are satisfied, the process is advanced to S26.

In step S26, the flag F is cleared to be F=0 and the timer watch is stopped.

In step S27, it is judged that whether the flag F is set to F=1 or not, and when the F is set to F=1, protective operations shown in steps S28 to S31 are performed. In step S28, the indicator lamp 265 is made on and off, and in step S29 the compressor 9 is set to be OFF (the operation of the protective portion). In step S30 (the operation of the pump control portion including the operations in steps S25 and S26), the drain pump is set to be ON, and in step S31, draft quantity of the draft fan 31 is set to be weak (L).

Based on the final settings as described in the above, the drain pump 40, the draft fan 31, etc. are operated and the signals such as the ON/OFF signal of the compressor 9 and the ON/OFF signal of the four-way valve are transmitted to the outdoor unit 3.

For example, in step S22, the ON/OFF of the compressor 9 is set, and in step S27, if the condition, F=1, is satisfied, the compressor 9 is set to be OFF in step S29. In the case of the drain pump 40, in step S22, the ON/OFF is set in interlocking with the ON/OFF of the compressor 9, but if F=1 is judged in step S27, the drain pump 40 is set to be ON in step S30. When the setting of the flag is changed from F=1 to F=0, the operation set in step S22 is resumed.

Therefore, the operation of the drain pump 40 is continued for 12 minutes to be measured by the timer watch even if the compressor 9 is stopped when either of the conditions (the conditions shown in step S23), the temperature of the heat exchanger of any indoor unit is below or equal to −1° C., or the open air temperature is below or equal to +15°, is satisfied.

Even the drain attached to the heat exchanger or defrosted water, melted water of ice attached to the heat exchanger, is collected in the main drain pan 47 after the stop of operation of the compressor 9, the overflow of the water from the pan is prevented by the continued operation of the drain pump 40.

The information of the setting of ON of the drain pump and the setting of L of the draft quantity is transmitted to the indoor unit(B) 2 in step S9, and the indoor unit(B) 2 is operated in the similar way to the operation of the indoor unit(A) 1.

Figure 14:
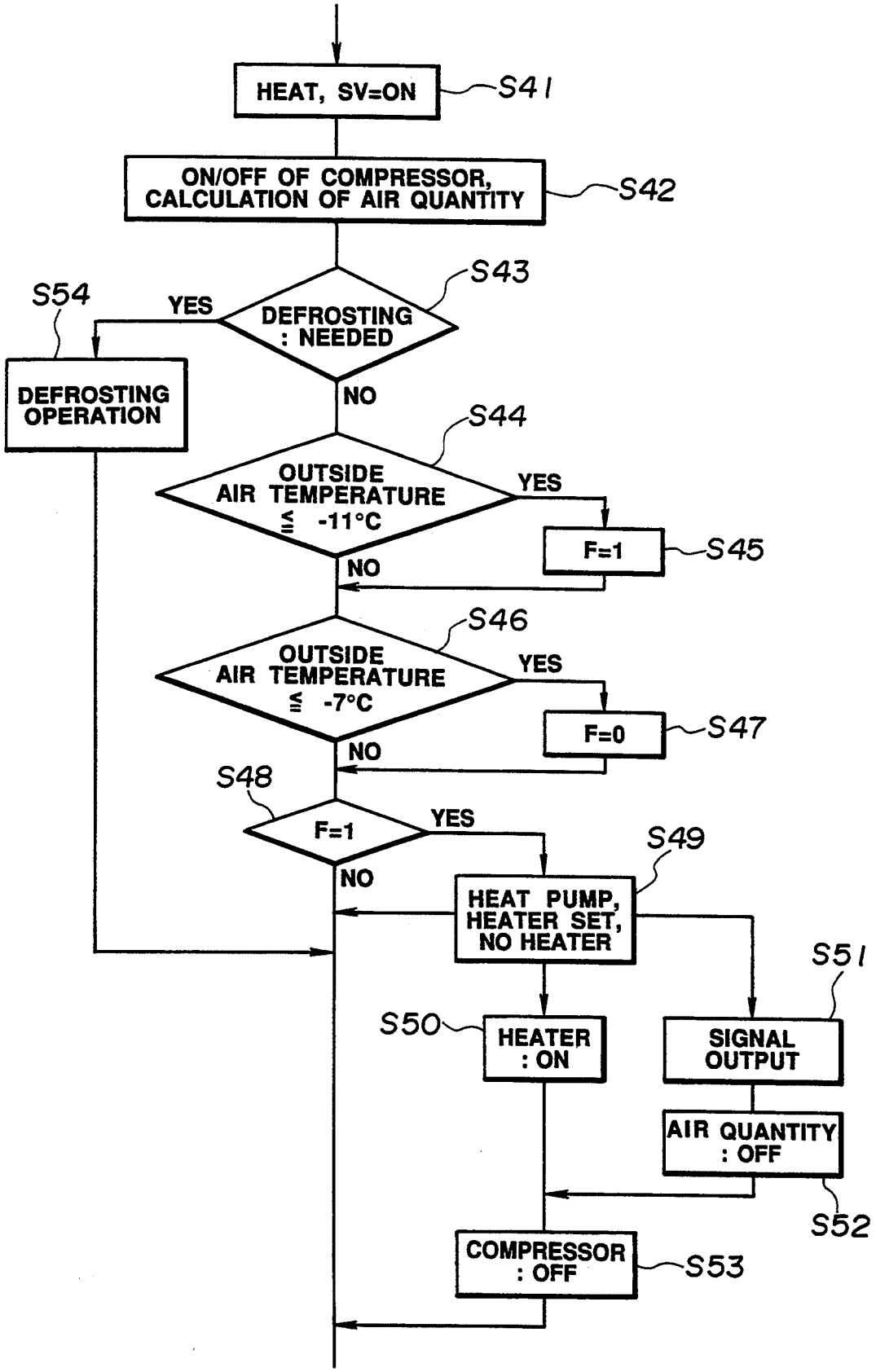
FIG. 14 is a flow chart showing a part of the operations, especially, in heating operation in step S8 shown in FIG. 12.

FIG. 14 is a flow chart showing the operation in the heating mode in step S8 shown in FIG. 12. In step S 41, the states of the equipment are set to make the indoor units and the outdoor unit operate in the heating mode. In step S42, the ON/OFF of the compressor 9 is set to ON when the room temperature detected by the thermistor 131 is lower than the set temperature. The ON state of the compressor 9 is continued at least for 3 minutes, and the OFF state is also continued at least for 3 minutes to secure the minimum necessary period of time for heating operation and to prevent the lock when the operation of the compressor 9 is restarted. Draft quantity is set based on the difference between the room temperature detected by the thermistor 131 and the set temperature. The draft quantity of each room is set based on the room temperature detected by each indoor unit.

In step S43, it is judged whether defrosting of the outdoor side heat exchanger 11 of the outdoor unit 3 is needed or not, and while the defrosting is needed, the process is advanced to step S54 for defrosting operation. The defrosting operation is performed through the processes as shown below: the four-way valve 10 is set to OFF (the state shown in FIG. 2), the indoor fans 30 and 31 are set to LL (very weak) or stop, the outdoor fan 29 is set to stop, the compressor 9 is set to ON; thus the outdoor side heat exchanger 11 is heated for defrosting.

In step S43, "Defrosting: needed" is held valid from the start of defrosting operation till the releasing condition of defrosting is satisfied. The releasing condition of defrosting is that the temperature of the outdoor side heat exchanger 11 reaches the specified temperature (for example, 12° C.) or when the defrosting operation is continued for the specified period of time (for 12 minutes).

In step S44, it is judged whether the open air temperature detected by the thermistor 204 of the outdoor unit 3 is below or equal to −11° C. or not. When the open air temperature is judged to be below or equal to −11° C., the process is advanced to step S45, and the flag F is set to F=1.

In step S46, it is judged whether the open air temperature detected by the thermistor 204 of the outdoor unit 3 is higher or equal to −7° C. or not. When the open air temperature is judged to be higher than or equal to −7° C., the process is advanced to step S47, and the flag is cleared to be F=0.

In step S48, it is judged whether the flag F is set to F=1 or not (whether the flag F is set or not). When the flag F is set, the process is advanced to step S49.

In step S49, it is judged whether an indoor unit comprises an auxiliary electric heater (the auxiliary heater 162) or not, and whether a compulsory heat pump operation is set or not; in other words, it is judged that if any setting among the "heater set", "no heater" or "heat pump" is selected.

In step S49, when "heat pump" is set, step S8 is executed as it is and the process is advanced to the next steps S9 and S10. In other words, heating operation in the heat pump cycle is continued independent of the open air temperature.

In step S49, when "heater-set" is set, the process is advanced to step S50 and the auxiliary heater 162 is energized. In other words, the output of the terminal B4 of the microprocessor 101 is changed to L potential, and the relay 163 is energized through the buffer 158 and the auxiliary relay 162 is energized. Then the process is advanced to step S53 and the compressor 9 is set to OFF. The draft quantity by the draft fan 31 is maintained at the draft quantity operated in step S42.

In step S49, when "no-heater" is set, the process is advanced to steps 51 to 53, and after a signal is output the draft fan 31 is stopped, and the compressor 9 is set to "stop". The signal is output from the terminal D7 of the microprocessor 201 of the outdoor unit 3 through the buffer 226. The signal is output as an operational signal to be given to the electric heater 305 to be used for an auxiliary heat source as the other heater shown in FIG. 15 (as the other ones, for example, a furnace, boiler, etc.).

Therefore, when the open air temperature becomes lower than or equal to −11° C., the air conditioning operation in the heat pump cycle is stopped and the operation of the electric heater 305 is started.

The electric heater 305 is energized when the auxiliary relay 302 is energized and the switch 303 is closed, and the heating operation is automatically started. For example, when the heater 305 is connected to an HA (home automation) system (a system in which the units of equipment in a dwelling house are organically connected to each other), the operation signal is given through the information transmitting path constituting the HA system.

The settings judged in step S49 are arranged to be able to select "heat pump", "heater set", or "no heater" according to the value of heat generation quantity of an electric heater to be used for auxiliary heating (auxiliary heater 162), or according to the setting conditions of the air conditioner, that is, whether it is a rare phenomenon that the open air temperature becomes lower than or equal to −11° C. or not in the place where the air conditioner is to be installed. As shown in FIG. 4, "heat pump" can be set at switch SW1=OFF and SW2=OFF, "heater set" can be set at SW1=ON and SW2=OFF, and "no heater" can be set at SW1=OFF and SW2=ON. When the heat generation quantity of the auxiliary heater 162 is small (about 2 kW), the capacity is good enough as an auxiliary heat source to be added to the heating operation in the heat pump cycle, but when the open air temperature becomes lower than or equal to −11° C. and the heating in the heat pump cycle cannot be obtained, in some case enough heating cannot be obtained by only the auxiliary heater 162 (When the heat generation quantity of the auxiliary heater 162 is in the order of 5 kW, heating capacity is considered to be enough.). In such a case, it is desirable from the point of view of energy efficiency to perform heating by the other heater (the electric heater 305 shown in FIG. 15, etc.), so that it is desirable that "no heater" is set.

In the case of heating operation as described in the above, when the heating capacity in the heating operation in the heat pump cycle is not enough caused by the low temperature of the open air, the heating operation by the air conditioner is stopped and the signal is output to operate the other heater (the electric heater 305, for example); thereby the energy efficiency in the heating operation can be maintained good. When the heat generation quantity of the auxiliary heater 162 is large enough, heating operation by the auxiliary heater 162 is performed.

Concerning the operation of the indoor unit(B) 2, in step S9, the same set values as the indoor unit(A) 1 are transmitted to the indoor unit(B) 2, so that the indoor unit(B) 2 is operated almost in the same way as the indoor unit(A) 1. When draft quantity is set at AUTO, however, every indoor unit is operated differently.

As described in detail in the above, in an air conditioner according to the present invention, when the open air temperature becomes lower than a specified temperature, the compressor is compulsorily stopped independent of the operations of the temperature control means, and the protective operations are displayed in a display means; therefore, it is made possible to prevent the breakage of a compressor caused by liquid compression which is caused by incomplete evaporation of the refrigerant in the indoor side heat exchanger due to a low open air temperature.

The drain pump is forced to operate for a specified period of time after the stop of operation of the compressor, and the drain water which drops from an evaporator (indoor side heat exchanger) after the stop of operation of the compressor can be continuously discharged, so that it is made possible to prevent the overflow of drain water into a room to be air conditioned.

While the drain pump is compulsorily operated, a draft fan is operated, which expedites the condensation of water on the surface of the evaporator, so that dropping of drain can be finished in a specified period of time.

A control means is provided which stops the heating operation in a heat pump cycle and outputs a signal for operating the other heater when the open air temperature becomes lower than a specified temperature; therefore, it is made possible to start a heating operation automatically by other heaters, an electric heater, a furnace, a boiler, etc., when the open air temperature becomes lower than a specified value, so that a sufficient heating capacity can be obtained even in a low open air temperature.

A signal for controlling the operation of an outdoor unit is output from the indoor unit(A) to the outdoor unit through a signal line, and a signal set in the indoor unit(A) is transmitted to the indoor unit(B) through a signal line, so that the setting of all indoor units can be easily performed by giving an operational signal to the indoor unit(A).

From the indoor unit(B), only a signal expressing a trouble in the indoor unit(B) can be selectively transmitted to the indoor unit(A), so that the load on the indoor unit(A) concerning signal reception can be lightened. In other words, the constitution of the controller of the indoor unit(A) can be simplified.

It is further understood by those skilled in the art that the foregoing description is a preferred embodiment of the disclosed device and that various changes and modifications may be made in the invention without departing from the spirit and scope thereof.

What is claimed is:

1. An air conditioner having:

an indoor side unit having an indoor side heat exchanger for performing heat exchange with the air in a room, an outdoor side unit having an outdoor side heat exchanger for performing heat exchange with the open air, and a refrigerating circuit for cooling said room being constituted of said indoor side heat exchanger, a compressor, said outdoor side heat exchanger, and an expansion device, comprising:

a temperature condition means for cooling said room in controlling said compressor to operate at a full power or to stop based on a temperature of said room, and a protective means for compulsorily stopping said compressor independently of said temperature condition means when the open air temperature becomes lower than a predetermined temperature.

2. An air conditioner described in claim 1, further comprising:

an indicate means for displaying an abnormality when said protective means acts.

3. An air conditioner described in claim 1, further comprising:

a pump for discharging the water dropped from the indoor side heat exchanger of said indoor unit to the outside of said indoor side unit, and a pump control means for maintaining said discharging by said pump at least a specified period of time after said protective means acts.

4. An air conditioner described in claim 3, further comprising:

a draft means for expediting the heat exchange between the air inside said room and said indoor side heat exchanger, and a means for operating the draft means while the pump is run.

5. An air conditioner comprising:

an outdoor side unit having a compressor and an outdoor side heat exchanger, a plurality of indoor side units each having an indoor side heat exchanger respectively, a refrigerating circuit being constituted using said indoor side heat exchangers, a compressor, an outdoor side heat exchanger, and an expansion device for cooling, and an indoor side control means A for controlling the operation of said specified indoor unit based on the change of a room temperature, and for cooling said room in generating a signal for controlling the operation of said compressor, an indoor side control means B for controlling the operations of said other indoor units, an outdoor side control means for controlling the operation of said outdoor unit and for stopping the operation of said compressor compulsorily independent of the signal from said indoor side control means A when the open air temperature becomes lower than a specified temperature, a means for transmitting a signal for controlling the operation of said outdoor unit from said indoor side control means A to said outdoor side control means, a means for giving a setting signal for controlling the operation of said specified indoor unit to said indoor side control means A, a means for transmitting a set signal set for controlling the operation of said specified indoor unit from said indoor side control means A to said indoor side control means B, and a means for transmitting a signal expressing a trouble which occurs in said other indoor unit from said indoor side control means B to said indoor side control means A.

6. An air conditioner comprising:

a single outdoor unit having a compressor and an outdoor side heat exchanger, a plurality of indoor units having indoor side heat exchangers respectively, and a controller which makes it possible to execute air conditioning operation using respective indoor units;

said controller comprising:

an outdoor side control means for controlling the operation of said outdoor unit, an indoor side control means A for controlling the operation of said specified indoor unit, an indoor side control means B for controlling the operation of said other indoor units, a first signal line for transmitting a signal for controlling the operation of said outdoor unit to said outdoor side control means in connecting said outdoor side control means and said indoor side control means A, a second signal line for transmitting a signal set for controlling the operation of said specified indoor unit from the specified indoor unit to the other indoor units, and for transmitting a signal expressing a trouble which occurs in the other indoor unit from the other indoor unit to the specified indoor unit in connecting said specified indoor unit and the other indoor units, and a remote controller for giving a set signal for controlling the operation of said specified indoor unit to said specified indoor unit.

7. An air conditioner comprising:

a single outdoor unit having a compressor and an outdoor side heat exchanger, a plurality of indoor units having indoor side heat exchangers respectively, and a controller;

said controller comprising:

an outdoor side control means for controlling the operation of said outdoor unit, an indoor side control means A for controlling the operation of said specified indoor unit, an indoor side control means B for controlling the operations of said other indoor units, a means for transmitting a signal for controlling said outdoor unit from said indoor side control means A to said outdoor side control means, a means for giving a setting signal for controlling the operation of said specified indoor unit to said indoor side control means A, a means for transmitting a setting signal set for controlling said specified indoor unit from said indoor side control means A to said indoor side control means B, and a means for transmitting a signal expressing a trouble which occurs in said other indoor unit from said indoor side control means B to said indoor side control means A.

* * * * *